US005449316A

United States Patent [19]

Strasbaugh

[11] Patent Number: 5,449,316

[45] Date of Patent: Sep. 12, 1995

[54] WAFER CARRIER FOR FILM PLANARIZATION

[76] Inventor: Alan Strasbaugh, 825 Buckley Rd., San Luis Obispo, Calif. 93401

[21] Appl. No.: 178,531

[22] Filed: Jan. 5, 1994

[51] Int. Cl.[6] ..... B24B 7/22

[52] U.S. Cl. ..... 451/289; 451/388; 451/287

[58] Field of Search ..... 51/283 R, 281 R, 235, 51/131.4, 131.2, 131.5, 132, 129; 451/28, 41, 283, 286, 288, 289, 290, 388

[56] References Cited

U.S. PATENT DOCUMENTS

| | | | |
|---|---|---|---|
| 4,897,966 | 2/1990 | Takahashi | 51/131.5 |
| 4,918,869 | 4/1990 | Kitta | 51/131.4 |
| 5,081,795 | 1/1992 | Tanaka et al. | 51/131.4 |

FOREIGN PATENT DOCUMENTS

| | | | |
|---|---|---|---|
| 1230858 | 10/1986 | Japan | 51/235 R |
| 0052967 | 3/1988 | Japan | 51/131.4 |
| 0216768 | 8/1989 | Japan | 51/131.4 |
| 4171170 | 6/1992 | Japan | 51/132 |
| 5069310 | 3/1993 | Japan | 51/283 R |

*Primary Examiner*—Robert A. Rose
*Attorney, Agent, or Firm*—Daniel C. McKown

[57] ABSTRACT

The apparatus is used to remove material uniformly from all regions of a wafer surface that is being polished. This is in contrast to conventional lapping machines which preferentially remove material from the high spots on the surface being polished so as to render the surface planar. The result of the present invention is achieved by providing a downwardly-opening plenum on the underside of a carrier. The opening is covered by a flexible membrane, and when a pressurized fluid is applied to the plenum, the membrane applies a uniform downward pressure across the entire upper surface of a wafer that is being polished. The uniform pressure results in a uniform removal of material all across the wafer. The wafer is typically 680 microns thick and the coating is typically two microns thick. Through use of the apparatus, the thickness of the coating is uniformly reduced to about 0.8 micron while maintaining the uniformity of the coating to within 0.02 micron.

2 Claims, 2 Drawing Sheets

WAFER CARRIER FOR FILM PLANARIZATION

BACKGROUND OF THE INVENTION

The present invention is in the field of semiconductor manufacturing and specifically relates to an apparatus for polishing and uniformly reducing the thickness of a thin film or coating that has been applied to a wafer composed of a semiconductor, typically single-crystal silicon.

Because of their thinness, the wafers are not rigid, but instead are somewhat flexible. However, they are not pliable like paper or metal foil. FIG. 1 shows (not to scale) a typical wafer, including its silicon substrate and the applied coating.

It is important to appreciate the extremely small thickness which the present invention controls. A typical wafer is several inches in diameter and about 680 microns thick; one micron is 1 millionth of a meter. Conventional lapping techniques, such as described in the patents discussed below are capable of producing wafer surfaces that are flat to within 2 or 3 microns. The coating with which the present invention is concerned is typically only about two microns thick. The thickness of the coating is extremely uniform across the wafer; variations in thickness of the coating are on the order of 0.02 micron. The apparatus and method of the present invention permits the thickness of the coating to be reduced to about 0.8 micron while maintaining the uniformity of the thickness of the coating. Further, this degree of control is obtained routinely on a production line using the apparatus of the present invention.

If a coated wafer of the type with which the present invention is concerned is laid on a rigid surface, as shown in the diagram of FIG. 2, and if a downward force is applied at the point indicated, the pressure transmitted to the underlying rigid surface is greatest directly beneath the point where the force is applied. The pressure will diminish at locations laterally displaced from the maximum pressure point.

If the wafer is very stiff, the applied force will be dissipated over a larger area; the pressure acts over a larger area, and because the combined product of pressure times area must equal the applied force, the pressure immediately beneath the point where the force is applied is less than it would be for a wafer that is less stiff.

In contrast, if the wafer of FIG. 2 is less stiff, the applied force will be mainly concentrated near the maximum pressure point, and the pressure there will be much greater than if the material were stiffer. That is exactly what occurs in the thin wafers with which the present invention is concerned.

FIG. 3 shows a wafer (that is assumed to have a planar upper surface) mounted in a conventional lapping apparatus. Here it is clear that material will be removed most rapidly from the high areas A and B, which will render the thin coating less uniform in thickness.

FIG. 4 shows a wafer (that is assumed to have a planar lower surface) mounted in a conventional lapping apparatus. From the discussion in connection with FIG. 2 it is clear that even though the lower surface of the wafer is assumed to be planar, material will be removed at different rates at various lateral positions, thereby rendering the thin coating less uniform rather than more uniform.

Reflecting upon the above discussion in connection with FIGS. 1–4, it is seen that so long as the thickness of the wafer is nonuniform, the use of a rigid carrier to force the wafer against the polishing surface necessarily results in nonuniform removal of the material, which destroys the uniformity of the thickness of the coating.

To remedy this situation, it is a practice in the art to include an insert consisting of a sheet of a resilient material between the carrier and the wafer. This tends to spread the applied downward force a little more uniformly across the wafer. The use of such an insert, such as in U.S. Pat. No. 5,205,082 discussed below, can never be fully effective because the insert is compressed most at the high spots and therefore the elastic restoring forces are also greatest at the high spots. Since the applied force is also greatest at the high spots, the use of an insert is only marginally effective. Further, the use of an insert complicates the mass-production process, since the inserts need to be changed from time to time and because they must be carefully installed.

The arrangement shown in FIG. 3 is, of course, the conventional way of producing flat surfaces, and by extension, parallel surfaces. However, as stated at the outset, neither of these is the purpose of the present invention. Instead, the purpose of the present invention is to uniformly reduce the thickness of a thin coating previously applied to one face of a wafer.

For this reason it is not surprising that the known prior art, which was concerned with producing flat surfaces or parallel surfaces, is not useful in solving the problem with which the present invention is concerned.

THE PRIOR ART

In U.S. Pat. No. 4,918,869 Kitta describes an apparatus for lapping a wafer. The wafer is adhesively bonded to the lower surface of a substantially rigid pressing plate. In accordance with Kitta's invention, a pressurized membrane of an elastic material applies a uniform pressure to the top of the rigid pressing plate, forcing it downward and forcing the wafer against the turn table. This results in a situation like that shown in FIG. 3, with the necessary result that some portions of the face of the wafer are polished more than others.

In U.S. Pat. No. 5,205,082 to Shendon et al. there is described apparatus for polishing a wafer. In this apparatus, an insert is used to adhere the wafer to the surface of the carrier. The insert covers the full surface of the carrier. A flexible but impermeable diaphragm connects the carrier to the remainder of the polishing head. Fluid pressure above the diaphragm pushes the diaphragm against the rigid carrier, whereby the carrier can move against the pressure of the diaphragm when necessary to accommodate irregularities in the polishing surface. The net result of this arrangement is that the wafer is pushed by the substantially rigid carrier against the polishing surface. The thicker portions of the wafer are subjected to a greater pressure and therefore are polished more than the other portions. As a result, the uniformity of any applied coating will be destroyed.

Both Takahashi in U.S. Pat. No. 4,897,966 and Tanaka et al. in U.S. Pat. No. 5,081,795 show apparatus for polishing wafers, in which the wafer is mounted on a rigid plate that pushes the wafer against a polishing surface. As discussed above, such a polishing technique would do more harm than good if applied to the problem of maintaining a uniform thickness in an applied coating.

Thus, the known prior art is concerned with the problem of producing a flat surface on a wafer. In contrast, the problem to which the present invention is addressed is that of removing material uniformly across a two micron thick coating that has been applied to the surface of a 680 micron thick wafer. From the above discussion, it is clear that the action of the prior art lapping machines, if applied to the problem of the present invention would, in fact, destroy the uniformity of the thin applied coating. Because the lapping machines known in the prior art were not applicable to the problem at hand, the present inventor was forced to find his own solution.

SUMMARY OF THE INVENTION

It is an object of the present invention to provide a way of uniformly removing a portion of a two micron thick film or coating that has been applied to a face of a 680 micron thick silicon wafer, so that the coating that remains on the wafer has a uniform thickness of, typically, only 0.8 micron.

More specifically, it is an object of the present invention to provide a polishing apparatus and method for uniformly removing a portion of the thin applied coating.

It is a further object of the present invention to provide an apparatus for uniformly reducing the thickness of a thin coating applied to a face of a wafer, which apparatus requires no judgment or intervention by its operator and which therefore is suitable for use in automated mass production.

In accordance with the present invention, the carrier which drives the wafer laterally across a polishing surface includes a plenum, the lower side of which is closed by a membrane that contacts the entire upper face of the wafer and that applies a downward pressure uniformly across the entire upper face of the wafer when the plenum is filled with a pressurized fluid. The uniform pressure results in a substantially uniform removal of material from all parts of the lower face of the wafer as it is polished.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 4:
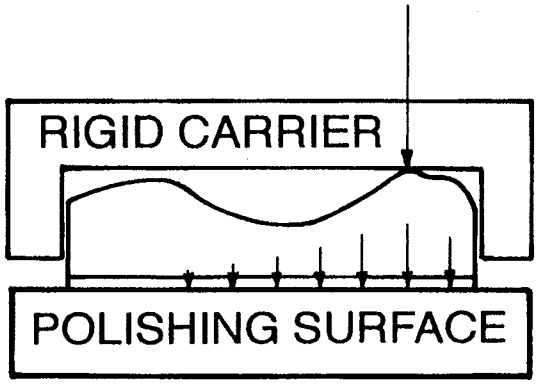
Fig. 4 (PRIOR ART)
FIG. 4 is a diagram illustrating the polishing of a wafer having high spots on its upper surface; and, FIG. 5 is a side elevational view in cross section of a preferred embodiment of the apparatus of the present invention.
Figure 3:
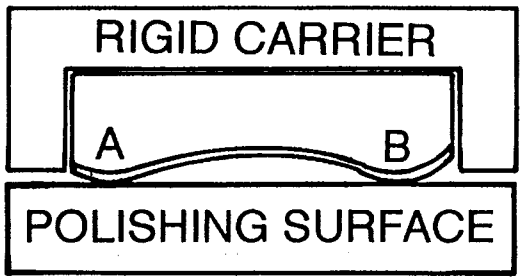
Fig. 3 (PRIOR ART)
FIG. 3 is a diagram illustrating the polishing of a wafer having high spots on its lower surface.
Figure 2:
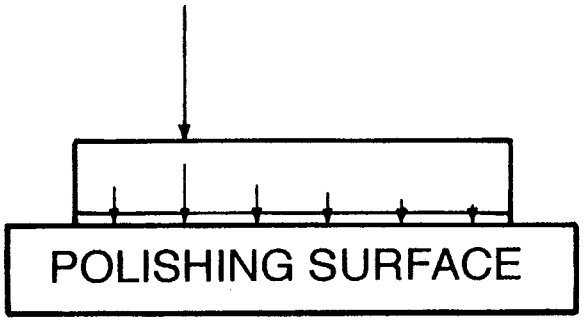
FIG. 2 is a diagram showing how a force applied at a point on the upper surface of a wafer is transmitted to various locations on the lower side of the wafer.
Figure 1:
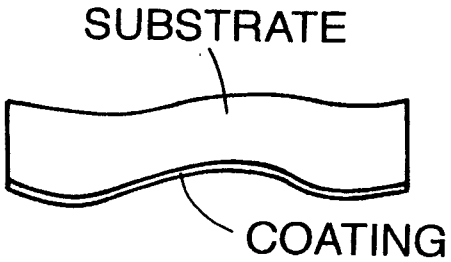
FIG. 1 is a diagram showing a wafer of the type with which the present invention is concerned, with the scale greatly exaggerated in the vertical direction.

The present invention is concerned with the problem of reducing the thickness of a thin coating that has been applied to one face of a much thicker wafer, while maintaining the uniformity of the thickness of the coating. In a typical instance, illustrated in FIG. 1, the wafer is several inches in diameter and 680 microns thick, and the face of the wafer is typically flat to within two or three microns. The applied coating is typically only two microns thick initially, and the use of the present invention permits the thickness of this coating to be reduced to only 0.8 micron typically, with the thickness maintained constant to within 0.02 micron in mass production.

Figure 5:
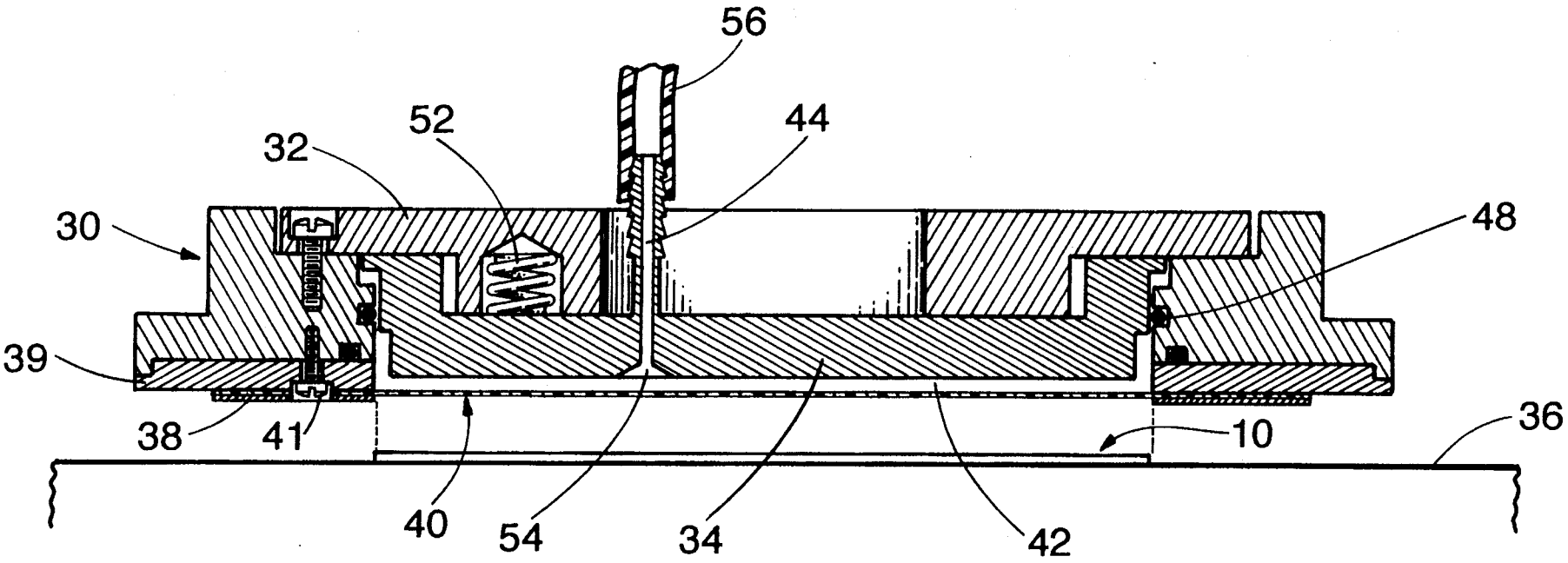

As best seen in FIG. 5, the carrier includes a ring-like part 30, a disk-like part 32, and a floating piston 34. The floating piston 34 is capable of limited vertical movement with respect to the ring-like part 30, and in FIG. 5 the floating piston 34 is shown at the upper limit of its travel. The ring-like part 30 is connected to the lower end of an arm (not shown) which serves to move the carrier laterally across the polishing surface 36, which rotates about a vertical axis.

The inside diameter of the washer 38 is slightly larger than the outside diameter of the wafer 10, so that the wafer 10 will fit loosely inside the washer 38. In this manner the wafer is held captive within the washer 38 as the polishing surface 36 rotates and as the carrier moves laterally. The periphery of the lower side of the membrane 40 is bonded to the washer 38, and then the periphery of the opposite side of the membrane is bonded to the thicker washer-like part 39, which in turn is fastened to the ring-like part 30 by screws, of which the screw 41 is typical.

In a preferred embodiment, the membrane is several hundred microns in thickness and is composed of a synthetic rubber. As can be appreciated by workers in the art, a membrane this thin is quite pliable and is utterly lacking in stiffness.

In FIG. 5, for illustrative purposes, the carrier is shown vertically spaced above the wafer 10; however, in use the carrier is lowered so that the lower side of the membrane 40 comes in contact with the upper face of the wafer 10.

When the wafer is being polished, a pressurized fluid is applied to the flexible tube 56, and the pressurized fluid is communicated to the plenum 42 via the passage 44. The pressure of the fluid in the plenum 42 drives the floating piston 34 to its upper limit position and causes the membrane 40 to bear against the upper face of the wafer with a pressure that is uniform across the wafer. It is the uniform pressure across the wafer that results in uniform removal of material from the coating on the lower face of the wafer.

In a companion application filed simultaneously with the present application and titled "WAFER-HANDLING APPARATUS", there is described a way of using the membrane 40 and the floating piston 34 for acquiring and releasing wafers of the type described herein, by applying a vacuum to the plenum 42. This application is incorporated herein by reference. The vacuum in the plenum 42 draws the floating piston 34 to its lower limit position. Springs, of which the spring 52 is typical, help to overcome the friction of the O-ring 48. In its lower position the floating piston 34 lightly touches the membrane 40 which is in contact with the wafer 10. The applied vacuum sucks the membrane 40 into recessed regions, of which the region 54 is typical, on the lower side of the floating piston 34, creating a region of lower-than-atmospheric pressure between the membrane and the upper face of the wafer. This region acts like a suction cup, causing the wafer to stick to the membrane-covered lower side of the floating piston, so that when the carrier is raised the wafer is lifted with it.

Thus, there has been described a polishing apparatus and method for reducing the thickness of a thin coating that has been applied to one face of a much thicker wafer while maintaining the uniformity of the thickness of the coating.

From the above discussion it is clear that the present invention solves a different type of problem from that solved by conventional lapping machines. Conventional lapping machines preferentially remove material from the high spots of a wafer, and this leads to nonuniformity in any coating on the lower surface of the wafer. In contrast, the apparatus of the present invention results in a uniform removal of material all across the surface that is being polished.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. An apparatus for polishing the lower face of a wafer that lies upon a rotating polishing surface and that has an upper face that is parallel to the lower face, said apparatus comprising:

a carrier holding the wafer against a rotating polishing surface, said carrier including a plenum having a downwardly-facing opening; and, a membrane covering the downwardly-facing opening, touching all portions of the upper face of the wafer and exerting a uniform downward pressure on all portions of the upper face of the wafer when a pressurized fluid is applied to said plenum;

said carrier further including a floating piston having a lower limit position in which said floating piston lies against said membrane and having an upper limit position in which said floating piston is spaced above said membrane.

2. The apparatus of claim 1 wherein said floating piston includes a passage for admitting a pressurized fluid to a space between said floating piston and said membrane.

* * * * *